United States Patent [19]

Bauer

[11] 4,290,453

[45] * Sep. 22, 1981

[54] REVERSING VALVE CONSTRUCTION AND METHOD OF MAKING THE SAME

[75] Inventor: Werner R. Bauer, Radnor, Pa.

[73] Assignee: Robertshaw Controls Company, Richmond, Va.

[ * ] Notice: The portion of the term of this patent subsequent to Mar. 20, 1996, has been disclaimed.

[21] Appl. No.: 44,179

[22] Filed: May 31, 1979

Related U.S. Application Data

[62] Division of Ser. No. 960,969, Nov. 15, 1978, Pat. No. 4,212,324, which is a division of Ser. No. 825,957, Aug. 19, 1977, Pat. No. 4,144,905.

[51] Int. Cl.[3] ..... F16K 11/07; F16K 31/363

[52] U.S. Cl. ..... 137/625.43; 251/186; 251/368; 137/625.29

[58] Field of Search ..... 137/625.43, 625.29, 137/625.66; 251/368, 183, 189, 176, 186

[56] References Cited

U.S. PATENT DOCUMENTS

| | | | |
|---|---|---|---|
| 3,032,312 | 5/1962 | Greenawalt | 137/625.29 X |
| 3,056,574 | 10/1962 | Greenawalt | 137/625.29 X |
| 3,349,800 | 10/1967 | Herion et al. | 137/625.29 X |
| 3,357,453 | 12/1967 | Mingrone et al. | 137/625.63 |
| 3,642,248 | 2/1972 | Benware | 251/172 |
| 3,985,154 | 10/1976 | Hargraves | 137/625.29 |

*Primary Examiner*—Arnold Rosenthal
*Attorney, Agent, or Firm*—Candor, Candor & Tassone

[57] ABSTRACT

A reversing valve construction having a housing provided with a chamber carrying a movable piston-like valve member therein that controls ports of a valve seat of the housing through the relative position of a cavity of the valve member relative to the ports. The ports comprise first, second and third ports disposed in spaced apart and straight line relation and the cavity bridges the first and second ports while exposing the chamber to the third port when the valve member is in one position thereof and bridges the second and third ports while exposing the chamber to the first port when the valve member is in another position thereof. A flexible sealing annular member is disposed between the valve member and the valve seat and surrounding the cavity to seal the cavity of the valve member to the valve seat while permitting sliding movement therebetween. A biasing member is operatively associated with the valve member and the flexible sealing member to urge and flex the sealing member into sealing engagement with the valve seat so as to tend to sealingly conform the flexible sealing member to the contour of the valve seat. The valve seat has an arcuate cross sectional surface and the valve member also has an arcuate cross sectional surface disposed adjacent the arcuate surface of the valve seat whereby the flexible sealing member is intermediate the arcuate surfaces.

2 Claims, 10 Drawing Figures

REVERSING VALVE CONSTRUCTION AND METHOD OF MAKING THE SAME

CROSS-REFERENCE TO RELATED APPLICATION

This application is a divisional patent application of its copending parent patent application, Ser. No. 960,969, filed Nov. 15, 1978, now U.S. Pat. No. 4,212,324, dated July 15, 1980, which, in turn, is a divisional patent application of its copending parent patent application, Ser. No. 825,957, filed Aug. 19, 1977, now U.S. Pat. No. 4,144,905, issued Mar. 20, 1979.

BACKGROUND OF THE INVENTION

1. Field of the Invention

This invention relates to an improved reversing valve construction and to methods for making such a reversing valve construction or the like.

2. Prior Art Statement

It is well known that reversing valve constructions for heat pump systems and the like have been provided wherein each includes a housing means carrying a movable piston-like valve member that controls port means of a valve seat means of the housing means through the relative position of cavity of the valve member relative to the port means.

For example, see the following four U.S. patents:

No. 3,032,312–Greenawalt

No. 3,056,574–Greenawalt

No. 3,357,453–Mingrone et al.

No. 3,985,154–Hargraves

Each reversing valve construction of the above four patents appears to have a rigid and non-flexible valve member disposed in sliding contact with its cooperating valve seat surface, the first three above patents each having the valve seat means thereof formed by a separate part disposed and secured in the housing means and being provided with a flat surface against which a flat surface of the movable valve member engages and slides in sealing relation therewith whereas the above patent to Hargraves has the valve seat means formed from a non-formed part of a cylindrical tubular housing member so as to be provided with an arcuate surface against which an arcuate surface of the valve member slides in sealing relation therewith.

Actual production devices that appear similar to the above four patents were examined and those similar to Mingrone et al. and Hargraves were found to have rigid metallic surfaces of the valve member to be disposed in sliding relation with respective metallic surfaces of the valve seat means, the device similar to the patent to Greenawalt, U.S. Pat. No. 3,032,312 was found to have a non-flexible and rigid plastic annular part forming the sliding surface of the valve member and being captured at its inner and outer peripheries by metallic retainers of the valve member whereby the entire valve member is rigid, and the device similar to the patent to Greenawalt, U.S. Pat. No. 3,056,574 was found to have the entire valve member formed of plastic material and of such a thickness that the same is not flexible.

It is also known to provide an outwardly biased annular sealing member around a cavity in a valve member to seal the same to a valve seat means.

For example, see the following U.S. Pat. No. 3,349,800–Herion et al.

It appears that the annular sealing member of the above patent to Herion et al. always surrounds a single port in the valve seat means to always interconnect that single port to the cavity of the valve member.

It is also known to outwardly bias a valve sealing member with a resilient O-ring like member disposed between the valve member and the valve sealing member.

For example, see the following U.S. Pat. No. 3,642,248—Benware

It appears that the sealing member of the above patent to Benware is disposed in an annular recess of a valve member and is urged outwardly from that recess to seal against a valve seat means by a resilient O-ring member also disposed in the recess between the valve member and the sealing member.

SUMMARY OF THE INVENTION

The efficiency of each such reversing valve constructions depends upon its leakage and pressure drop characteristics across the valve member thereof so that the closer the tolerances can be made between the mating surfaces of the valve member and the valve seat means, the more efficient is the resulting reversing valve construction.

However, it was found according to the teachings of the invention in applicant's copending patent application, Ser. No. 825,956 filed Aug. 19, 1977, that is now abandoned that improved sealing means can be provided between such a movable valve member and its cooperating valve seat means to improve the efficiency of the resulting reversing valve construction.

In particular, one embodiment of that invention provides a flexible annular sealing member disposed between the valve member of the reversing valve construction and the valve seat means thereof and surrounding the cavity of the valve member to seal the passage means of the valve member to the valve seat means while permitting sliding movement therebetween, the flexible sealing member being urged into sealing engagement with the valve seat means by biasing means that is operatively associated with the valve member and the flexible sealing member.

It is a feature of this invention to utilize such a sealing means with a housing means and valve member that have arcuate cross-sectional mating surfaces, such mating surfaces being provided in the aforementioned patent to Hargraves, U.S. Pat. No. 3,985,154.

In particular, one embodiment of the reversing valve construction of this invention provides a housing means that has the valve seat means thereof formed with an arcuate cross-sectional surface, the valve member also being formed with an arcuate cross-sectional surface disposed adjacent the arcuate surface of the valve seat whereby the flexible sealing member of the aforementioned copending patent application is disposed intermediate the arcuate surfaces.

In this manner, the housing means of this invention can be made from a tubular member in the same manner as the housing means of the aforementioned U.S. Pat. No. 3,985,154 as a part of the cylindrical side wall means of the tubular housing member of this invention forms the valve seat without further forming thereof.

Accordingly, it is an object of this invention to provide an improved reversing valve construction having one or more of the novel features of this invention as set forth above or hereinafter shown or described.

Another object of this invention is to provide a method of making such a reversing valve construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 2 is a cross-sectional view taken on line 2—2 of FIG. 1 and illustrates the prior art reversing valve construction of FIG. 1 in a heat pump system or the like.

DESCRIPTION OF THE PREFERRED EMBODIMENTS

Figure 1:
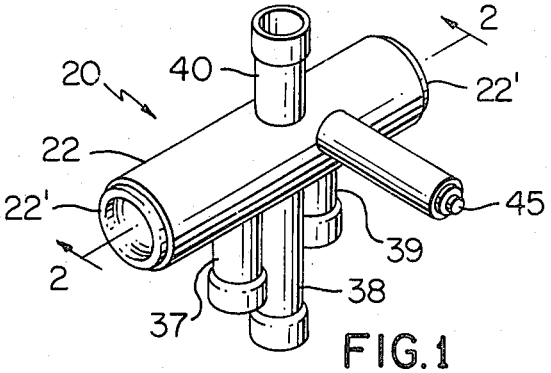
FIG. 1 PRIOR ART
FIG. 1 is a perspective view of a prior art reversing valve construction.

While the various features of this invention are hereinafter described and illustrated as being particularly adapted to provide a reversing valve construction for a heat pump system, it is to be understood that the various features of this invention can be utilized singly or in any combination thereof to provide a reversing valve construction for other systems as desired.

Therefore, this invention is not to be limited to only the embodiments illustrated in the drawings, because the drawings are merely utilized to illustrate one of the wide variety of uses of this invention.

Figure 2:
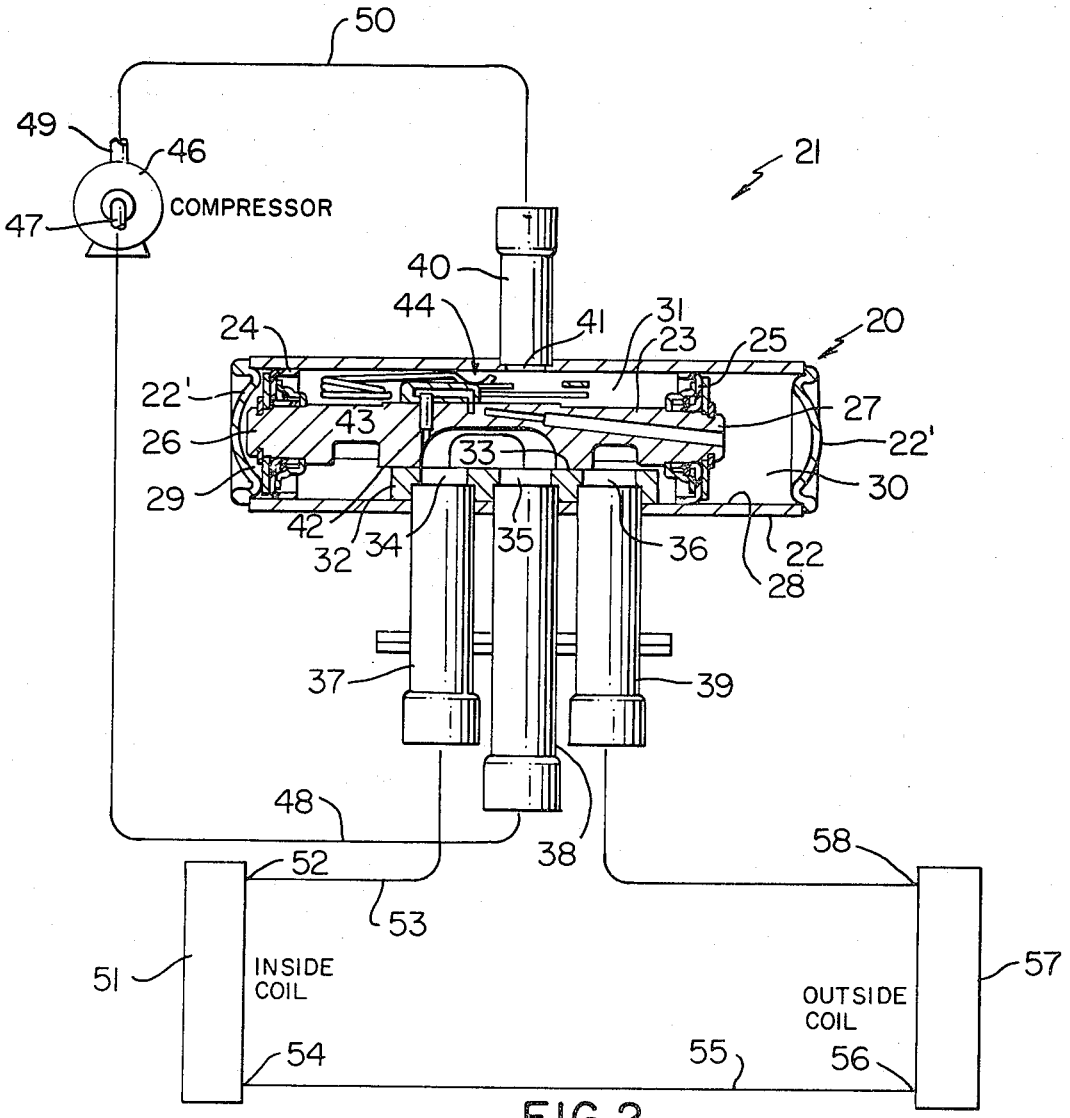
FIG. 2 PRIOR ART

Referring now to FIGS. 1 and 2, a prior known reversing valve construction is generally indicated by the reference numeral 20 and is illustrated in FIG. 2 for controlling a heat pump system that is generally indicated by the reference numeral 21, the reversing valve construction 20 being fully disclosed and claimed in the aforementioned U.S. Pat. No. 3,357,453 to Mingrone et al. which provides all of the details of the structure and operation of the reversing valve construction 20 so that the same need not be fully described herein.

However, in order to understand the improved features of this invention, the prior known reversing valve construction 20 will be generally described in connection with the heat pump system 21.

In particular, the prior known reversing valve construction 20 includes a metallic tubular housing member 22 having a movable metallic piston-like valve member 23 slidingly disposed therein and having piston portions 24 and 25 disposed at the opposed ends 26 and 27 thereof to sealingly cooperate with the internal peripheral surface 28 of the tubular housing member 22 and end closures 22′ to define end chambers 29 and 30 therewith and separating the end chambers 29 and 30 from a central chamber 31 thereof.

A metallic valve seat member 32 is secured in the housing member 22 and defines a flat valve seat surface 33 that is interrupted by three ports 34, 35 and 36 respectively fluidly interconnected to metallic tubular connectors 37, 38 and 39 while a similar metallic tubular connector 40 is disposed in fluid communication with a port 41 formed in the tubular housing member 22 opposite the valve seat 32 as illustrated.

The movable valve member 23 has a lower flat surface 42 disposed in sliding and sealing engagement with the flat surface 33 of the valve seat 32 and is interrupted by a cavity 43 that defines a passage means which is adapted to fluidly and sealingly interconnect the ports 34 and 35 of the valve seat 32 together when the valve member 23 is disposed in the position illustrated in FIG. 2 while the port 36 is permitted to be disposed in fluid communication with the central chamber 31 of the housing means 32 and, thus, to the tubular connector 40 as illustrated. However, when the valve member 23 is moved to the right in FIG. 2, the passage means 43 of the valve member 23 fluidly and sealingly interconnects the ports 35 and 36 together while permitting the port 34 to be disposed in fluid communication with the internal chamber 31 of the housing means 22 and, thus, in fluid communication with the tubular connector 40 for a purpose hereinafter described.

The movement of the valve member 23 relative to the housing means 22 is accomplished by directing fluid pressure to either the chamber 29 or the chamber 30 by means of a movable pilot valve means 44 carried on the valve member 23 and being controlled by a solenoid operated plunger 45, FIG. 1, in a manner fully set forth in the aforementioned U.S. Pat. No. 3,357,453.

The heat pump system 21 includes a refrigerant compressor 46 having the inlet side 47 thereof interconnected by a passage 48 to the tubular connector 38 while its outlet side 49 is interconnected by a passage 50 to the tubular connector 40.

An inside coil 51 of the heat pump system 21 has one side 52 thereof interconnected by a passage 53 to the tubular connector 37 while the other side 54 of the inside coil 51 is interconnected by an expansion capillary passage 55 to one side 56 of an outside coil 57. The other side 58 of the outside coil 57 is interconnected by a passage 59 to the tubular connector 39.

When the valve member 23 of the reversing valve 20 of the system 21 is disposed in the position illustrated in FIG. 2 by means of the pilot valve means 44 directing fluid pressure to the end chamber 30 while exhausting the end chamber 29, the heat pump system 21 is acting in its cooling cycle as the hot gas output from the output side 49 of the compressor 46 is being directed through the chamber 31 of the reversing valve 20 into the tubular connector 39 and, thus, to the side 58 of the outside coil which then returns through the expansion capillary passage 55 to the inside coil 51 and through the interconnected ports 34 and 35 of the valve seat 52 to the inlet side 47 of the compressor 46 whereby the inside coil 51 provides its cooling function.

Should it be desired to reverse the heat pump system 21 to a heating cycle thereof, the pilot valve means 44 is actuated so as to direct fluid pressure to the end chamber 29 of the reversing valve 20 while exhausting the end chamber 30 thereof to move the movable valve member 23 to the right in FIG. 2 to now interconnect the ports 35 and 36 through the passage 43 of the valve member 23. In this manner, the flow of hot gases from the outlet 49 of the compressor 46 is now directed to the port 34 of the valve seat 32 and, thus, to the side 52 of the inside coil which now performs its heating function. The return from the inside coil 51 is directed by the expansion capillary passage 55 to the outside coil 57 and, thus, from the outside coil 57 through the interconnected passages 36 and 35 of the valve seat 32 back to the inlet side 47 of the compressor 46 in a manner well known in the art.

Thus, it can be seen that the reversing valve construction 20 can be utilized to reverse the cycle of operation of heat pump system 21 in the above manner.

However, the efficiency of the reversing valve construction 20 depends upon leakage and pressure drop across the valve member 23 caused by the high pressure in chamber 31 and the low pressure in the passage means 43 of the valve member 23 and this is controlled by the sealing effect between the cooperating flat surfaces 42 and 33 of the valve member 23 and valve seat 32 as the flow of low pressure fluid continuously takes place through the passage means 43 of the valve member 23 and its particular pair of sealed ports 34 and 35 or 35 and 36 while the chamber 31 containing the valve member 23 is under a high pressure as long as the system 21 is operating.

As previously stated, it was found according to the teachings of the invention of applicant's aforementioned copending patent application that improved sealing can be provided between the movable valve member 23 and the valve seat 32 of the prior known reversing valve construction 20 to improve upon the efficiency thereof.

It was also previously stated that it was a feature of this invention to utilize such improved sealing means with a housing means and a valve member that have cooperating arcuate cross-sectional surfaces.

Accordingly, such an improved reversing valve construction of this invention is generally indicated by the reference numeral 20A in FIGS. 3–6 and parts thereof similar to the reversing valve construction 20 previously described are indicated by like reference numerals followed by the reference letter "A."

As illustrated in FIGS. 3–6, the reversing valve construction 20A of this invention includes the tubular housing means 22A formed of metal or any other suitable material and a movable valve member 23A formed of metal or any other suitable material, but instead of the separate metallic valve seat member 32 of the valve construction 20, an integral and homogeneous part of the tubular housing means 22A itself defines the valve seat means 32A which has an arcuate cross-section surface 33A that is interrupted by the ports 34A, 35A and 36A which respectively receive suitably shaped ends 60, 61 and 62 of the tubular connectors 37A, 38A and 39A to complete the valve seat means 32A in a manner similar to the aforementioned patent to Hargraves, U.S. Pat. No. 3,985,154.

In this manner, it can be seen that the tubular housing means 22A of the reversing valve construction 20A of this invention can be formed by merely providing the tubular housing member 22A with a substantially cylindrical internal peripheral surface 63 throughout the length thereof of which a part 64 thereof defines the arcuate surface 33A of the valve seat means 32A so that no separate metallic valve seat member 32 need be provided in the reversing valve construction 20A of this invention as is required in the reversing valve construction 20 previously described.

Figure 3:
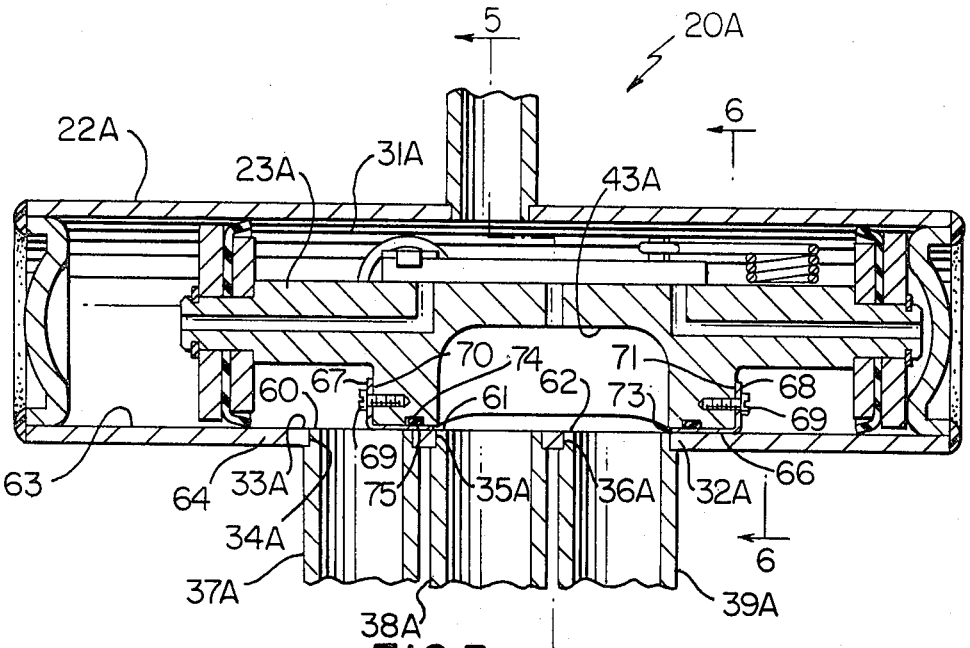
FIG. 3 is an enlarged cross-sectional view similar to FIG. 2 and illustrates one of the improved reversing valve constructions of this invention.
Figure 4:
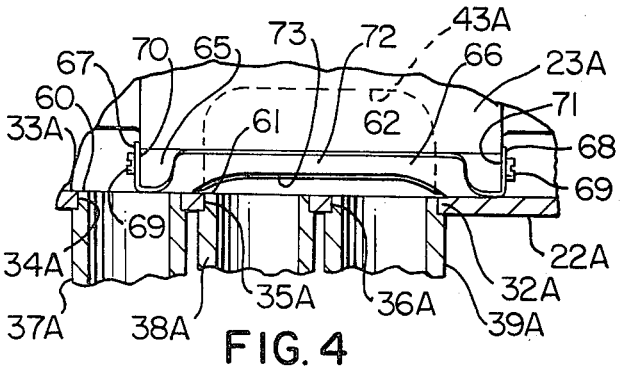
FIG. 4 is a fragmentary view similar to FIG. 3 and illustrates the valve member and sealing member therefor in elevation.
Figure 5:
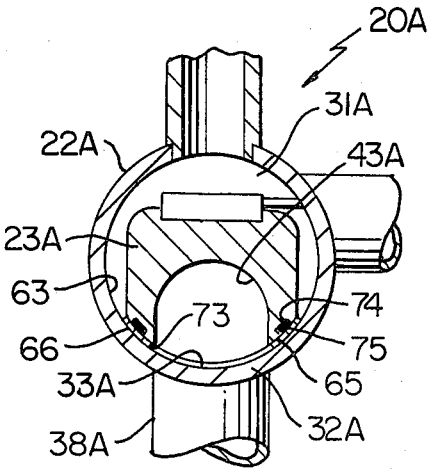
FIG. 5 is a cross-sectional view taken on line 5—5 of FIG. 3.
Figure 6:
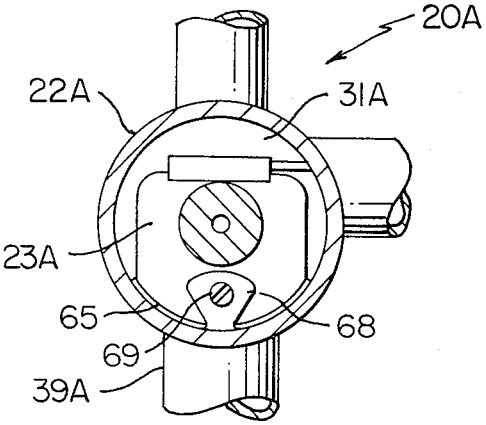
FIG. 6 is a cross-sectional view taken on line 6—6 of FIG. 3.
Figure 7:
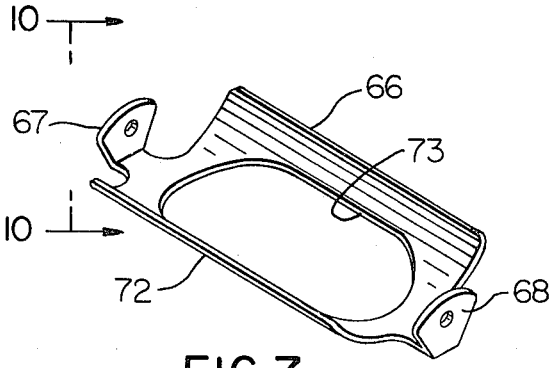
FIG. 7 is a perspective view of the improved sealing member of this invention that is utilized in the reversing valve construction of FIGS. 3—6.

The movable valve member 23A has an arcuate cross sectional surface 65 that is adapted to be disposed closely adjacent the arcuate surface 63 of the valve seat means 32A in the manner illustrated in FIG. 5. However, a thin flexible metallic shim or sealing member 66 shaped in the annular manner illustrated in FIG. 7 and having opposed ends 67 and 68 which are respectively adapted to be secured by threaded fastening members 69 to opposed shoulders 70 and 71 of the valve member 23A as illustrated in FIG. 3 is so arranged that an annular portion 72 of the sealing member 66 is adapted to float relative to the arcuate surface 65 of the valve member 23A for a purpose hereinafter described.

The valve member 23A is provided with the cavity or passage means 43A that interrupts the arcuate surface 65 thereof and is disposed in alignment with the opening 73 which passes through the scaling member 66 in the manner illustrated.

The arcuate surface 65 of the valve member 23A is also interrupted by an annular recess 74 which surrounds the opening 43A thereof and which receives an annular biasing member 75, such as a rubber-like O-ring that continuously urges the annular portion 72 of the metallic sealing shim 66 against the arcuate surface 33A of the valve seat means 32A so as to seal the internal chamber 31A from the particular pair of ports 34A and 35A or 35A and 36A being interconnected together by the passage 43A of the valve member 23A for the reasons previously described.

In this manner, the force of the biasing means 75 will continuously resiliently urge and flex the sealing member 66 into sealing engagement with the arcuate surface 33A of the valve seat means 32A and thereby take up any tolerances between the arcuate surface 65 of the valve member 23A and the arcuate surface 33A of the valve seat means 32A as well as cause the sealing member 66 to conform fully to the contour of the arcuate surface 33A of the valve seat means 32A. In addition, the biasing means 75 provides fluid sealing between the valve member 23A and the flexible sealing member 66 whereby an effective sealing arrangement is provided for the valve member 23A by the flexible sealing member 66 and biasing means 75.

Therefore, it can be seen that the reversing valve construction 20A of this invention can be formed by the method of this invention in the manner previously described to include the flexible sealing means 66 between the valve member 23A and the valve seat 32A so that the reversing valve construction 20A can effectively operate in a manner now to be described.

As the valve member 23A of the valve construction 20A is shifted from left to right or right to left in the tubular housing means 22A, in the same manner and for the same purpose as previously described, it can be seen that the sealing member 66 slides in sealing engagement on the arcuate surface 33A of the valve seat means 32A to seal the resulting interconnected ports 35A and 36A or 34A and 35A from the intermediate pressurized chamber 31A of the tubular valve member 22A while fluidly interconnecting the particular ports together as previously set forth, the flexible sealing member 66 being continuously urged and flexed into sealing engagement with the arcuate surface 33A of the valve seat means 32A by the biasing means 75 so that the annular sealing member 66 conforms to the contour of the surface 33A of the valve seat means 32A in a more effective manner than the cooperating flat metallic surfaces 42 and 33 of the valve member 23 and the valve seat member 32 of the previously described prior known reversing valve construction 20.

Therefore, it can be seen that the reversing valve construction 20A of this invention provides a flexible sealing member 66 disposed between the valve member 23A and the valve seat means 32A to seal the passage means 43A of the movable piston-like valve member 23A to the valve seat means 32A while permitting sliding movement therebetween, the biasing means 75 being operatively associated with the valve member 23A and with the flexible sealing member 66 to continuously urge the flexible sealing member 66 into sealing engagement with the valve seat means 32A while fluid sealing the flexible member 66 to the valve member 23A.

In this manner the tubular housing member 22A of this invention need not have a separate valve seat member disposed therein nor does the cylindrical side wall means thereof need be formed in any manner other than the mere forming of the ports 34A–36A therethrough in order to interconnect the tubular connectors 37A–39A therethrough to complete the valve seat means 32A.

While the sealing means 66 of the reversing valve construction 20A of this invention is illustrated and described as being formed of metallic material and being secured to the valve member 23A, it is to be understood that the scaling means 66 could be formed of any desired material and be biased in any of the manners illustrated and described in the aforementioned copending patent application.

Figure 8:
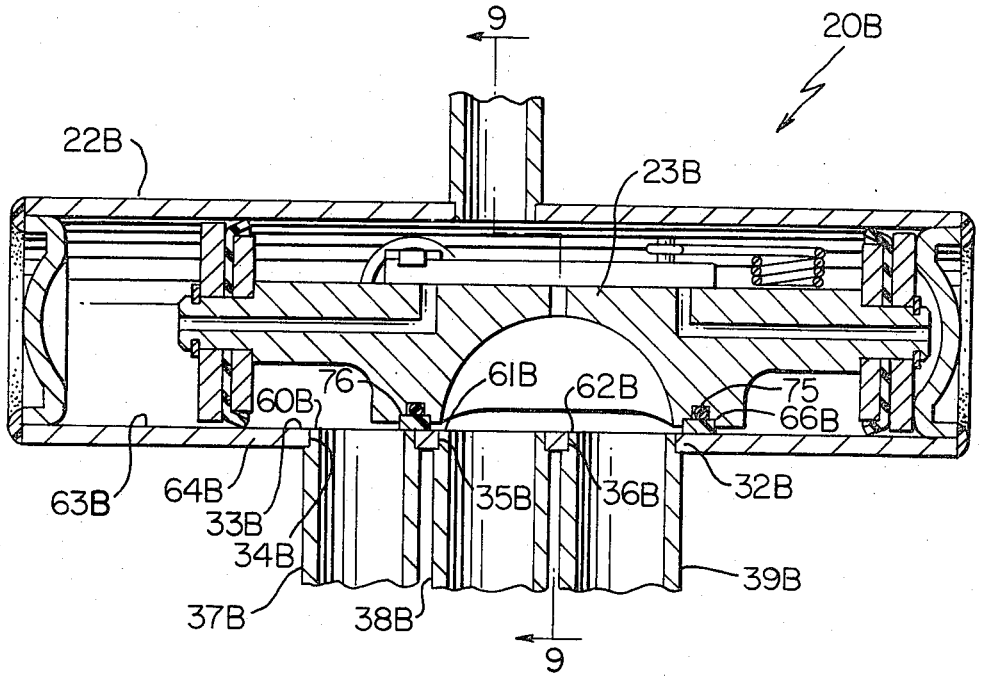
FIG. 8 is a fragmentary cross-sectional view similar to FIG. 3 and illustrates another embodiment of the reversing valve construction of this invention.
Figure 9:
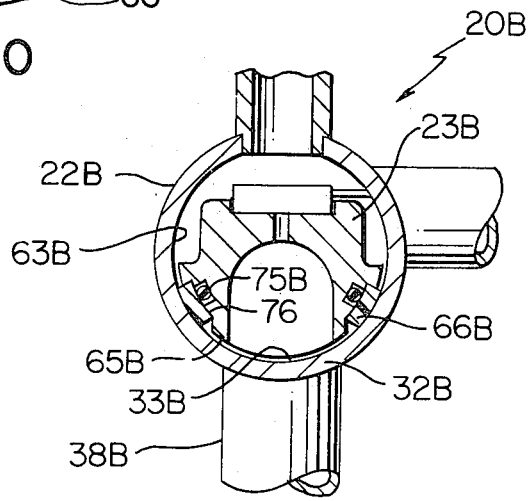
FIG. 9 is a cross-sectional view taken on line 9—9 of FIG. 8.

For example, reference is now made to FIG. 8 and 9 wherein another reversing valve construction of this invention is generally indicated by the reference numeral 20B and parts thereof similar to the reversing valve constructions 20 and 20A are indicated by like reference numerals followed by the reference letter "B."

As illustrated in FIGS. 8 and 9, it can be seen that the tubular housing member 22B also does not have a separate valve seat member disposed therein as part 64B of the internal peripheral surface 63B thereof provides the valve seat means 32B and thereby has an arcuate surface 33B that is interrupted by the openings or ports 34B, 35B and 36B which respectively receive cooperating ends 60B, 61B and 62B of the tubular connectors 37B, 38B and 39B as illustrated.

The lower surface 65B of the valve member 23B is shaped with an arcuate cross-section as illustrated in FIG. 9 which is disposed closely adjacent the arcuate surface 33B of the valve seat means 32B and is interrupted by the annular groove 76 that receives a flexible annular sealing member 66B and biasing means 75B so that the flexible sealing member 66B will perform its sealing function with the valve seat surface 33B in the manner previously described through the continuous urging of the biasing means 75B in the manner previously described.

Since the operation of the reversing valve construction 20B is the same as the reversing valve construction 20B previously described, the operation of the reversing valve construction 20B need not be described.

It has been found according to the teachings of the invention of the aforementioned copending patent application that the sealing member 66B can be formed of polytetrafluoroethylene sold under the trademark TEFLON-TFE by the E. I. Du Pont de Nemours, Inc. of Wilmington, Del.

Figure 10:
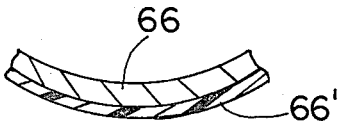
FIG. 10 is an enlarged fragmentary cross-sectional view taken on line 10—10 of FIG. 7 and illustrates another embodiment of this invention.

Such a sealing member 66B can be approximately 0.030 of an inch thick whereas as illustrated in FIG. 10 the more flexible metallic shim 66 can be approximately 0.010 of an inch thick and be provided with a 0.005 of an inch thick Teflon Tape 66′ on the sealing side thereof so that the overall thickness of the sealing member 66 is approximately 0.015 of an inch.

Therefore, it can be seen that this invention provides an improved reversing valve construction and method of making the same.

While the forms and methods of this invention now preferred have been illustrated and described as required by the Patent Statute, it is to be understood that other forms and method steps can be utilized and still fall within the scope of the appended claims.

What is claimed is:

1. In a reversing valve construction having a housing means provided with a chamber carrying a movable piston-like valve member therein that controls port means of a valve seat means of said housing means through the relative position of a cavity of said valve member relative to said port means, said port means comprising first, second and third ports disposed in spaced apart and straight line relation and said cavity bridging said first and second ports while exposing said chamber to said third port when said valve member is in one position thereof and bridging said second and third ports while exposing said chamber to said first port when said valve member is in another position thereof, the improvement comprising a relatively thin and flexible sealing member secured to said valve member and disposed between said valve member and said valve seat means and surrounding said cavity to seal said cavity to said valve seat means while permitting sliding movement therebetween, said flexible sealing member including a relatively thin tape of polytetrafluoroethylene material on the side thereof that faces said valve seat means and a thin metallic shim-like member having said tape of polytetrafluoroethylene material secured to one side thereof.

2. In a method of making a reversing valve construction having a housing means provided with a chamber carrying a movable piston-like valve member therein that controls port means of a valve seat means of said housing means through the relative position of a cavity of said valve member relative to said port means, said port means comprising first, second and third ports disposed in spaced apart and straight line relation and said cavity bridging said first and second ports while exposing said chamber to said third port when said valve member is in one position thereof and bridging said second and third ports while exposing said chamber to said first port when said valve member is in another position thereof, the improvement comprising the steps of securing a relatively thin and flexible sealing member to said valve member so as to be disposed between said valve member and said valve seat means and surround said cavity to seal said cavity to said valve seat means while permitting sliding movement therebetween, forming said flexible sealing member to include a relatively thin tape of polytetrafluoroethylene material on the side thereof that faces said valve seat means and to include a thin metallic shim-like member, and securing said tape of polytetrafluoroethylene material to one side of said shim-like member.

* * * * *